US006409027B1

(12) United States Patent
Chang et al.

(10) Patent No.: US 6,409,027 B1
(45) Date of Patent: Jun. 25, 2002

(54) DISPENSING TRAY FOR DISPLAY CONSOLE

(75) Inventors: Dennis L. Chang, East Brunswick, NJ (US); Larry R. Enochs, Columbia, PA (US); Mark R. Hernick, Chadds Ford, PA (US); Christopher T. Rich, Lancaster, PA (US)

(73) Assignee: Oneida Ltd., Oneida, NY (US)

( * ) Notice: Subject to any disclaimer, the term of this patent is extended or adjusted under 35 U.S.C. 154(b) by 0 days.

(21) Appl. No.: 09/802,637

(22) Filed: Mar. 9, 2001

(51) Int. Cl.[7] ..... A47F 5/00
(52) U.S. Cl. ..... 211/59.3; 211/184; 312/71
(58) Field of Search ..... 211/59.3, 51, 184, 211/175; 312/61, 71

(56) References Cited

U.S. PATENT DOCUMENTS 5,050,748 A * 9/1991 Taub ..... 211/59.2
5,240,126 A * 8/1993 Foster et al. ..... 211/59.3
5,542,552 A * 8/1996 Yablans et al. ..... 211/59.3
5,638,963 A * 6/1997 Finnelly et al. ..... 211/59.3
5,685,664 A * 11/1997 Parham et al. ..... 211/59.3 X
5,839,588 A * 11/1998 Hawkinson ..... 211/59.3
5,855,281 A * 1/1999 Rabas ..... 211/59.3
5,904,256 A * 5/1999 Jay ..... 211/59.2
6,082,558 A * 7/2000 Battaglia ..... 211/59.3
6,227,385 B1 * 5/2001 Nickerson ..... 211/59.3

* cited by examiner

*Primary Examiner*—Robert W. Gibson, Jr.
(74) *Attorney, Agent, or Firm*—Wall Marjama & Bilinsk LLP

(57) ABSTRACT

Apparatus for displaying and dispensing flat objects of different widths from a tray that includes an open top tray having a bottom wall, opposed side walls, a front wall and a back wall. A pair of elongated panels are slidably mounted in the bottom wall of the tray so that they can move along independent paths of travel from the back wall toward the front wall. Wound spring motors urge the panels toward the front wall of the tray so that flat articles of a first width stacked in the tray between one panel and the front wall will be supported in an upright position and the panel will automatically move forward when one of the articles is removed from the tray. The panel can be held in a coplanar side by side relationship by removable connectors whereby articles of greater width can be stacked in the tray.

11 Claims, 6 Drawing Sheets

DISPENSING TRAY FOR DISPLAY CONSOLE

BACKGROUND OF THE INVENTION

This invention relates to a tray for displaying and dispensing flat articles and, in particular, flat boxes having different widths.

Some articles, such as table flatware, are packaged in boxes of differing widths. For example, a full place-setting will be packed in a box of a first width while two place-settings will be packaged in a box that is about twice as wide as the first package. Retailers find it to their advantage to display both size boxes together in the same display cabinet, however, it has long been a problem to effectively display both boxes in close proximity so that a potential customer can make a comparison at the point of sale. Oftentimes, in order to effectively display the different size packages, different display units must be employed, thereby increasing the cost of the display. Different size display units also tend to detract from the display.

Flat articles such as boxes are generally displayed upright in shallow bins or trays. Some trays are equipped with back walls that can be moved forward toward the front wall of the tray as boxes are removed. Automatic repositioning of the rear wall is sometimes achieved by a spring that is arranged to bias the rear wall toward the front wall. Free movement of the rear wall, however, is difficult to maintain because the wall oftentimes cants in the tray and become jammed. The different size trays are also difficult to align on shelves and are easily moved out of alignment when the contained articles are handled or removed form the trays.

BRIEF SUMMARY OF THE INVENTION

It is therefore an object of the present invention to improve apparatus for displaying and dispensing flat articles.

A further object of the present invention is to provide a display tray that will accommodate flat articles of different widths.

A still further object of the present invention is to provide a display tray with an improved movable wall for automatically moving the stored articles forward in the tray as the articles are dispensed from the trays.

Another object of the present invention is to mount trays for displaying different size flat articles upon a display shelf so that the trays remain in alignment as articles are removed from the trays.

These and other objects of the invention are attained by apparatus for displaying and dispensing flat articles that includes a shallow open top tray having a bottom wall, opposed side walls, and a front and rear wall. A pair of elongated flat panels are slidably mounted in a side by side relationship in the bottom wall of the tray. The panels extend upwardly from the bottom wall through the open top of the tray. A wound ribbon type spring is connected to each panel to bias the panels toward the front of the tray. Articles stacked between the front wall of the tray and the panels are automatically moved forward as the stack is depleted. The panels are arranged to operate independently to dispense articles of a first width. Removable connectors are used to hold the panels in coplanar alignment so that the panels will act in concert to dispense articles of a second larger width from the tray.

BRIEF DESCRIPTION OF THE DRAWINGS

For a better understanding of these and other objects of the present invention, reference will be made to the following detailed description of the invention which is to be read in association with the accompanying drawings, wherein.

DETAILED DESCRIPTION OF THE INVENTION

Figure 1:
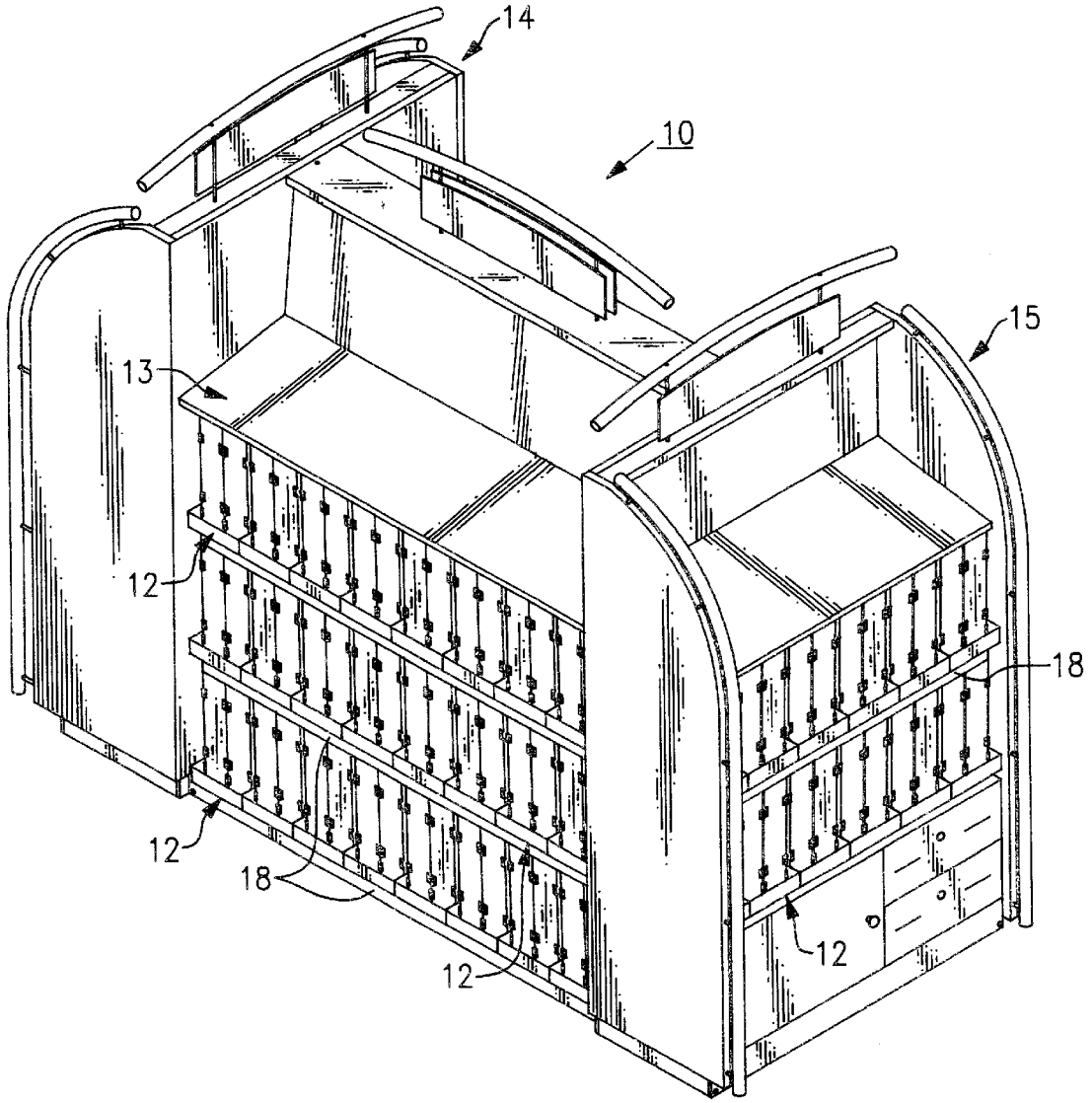
FIG. 1 is a front perspective view of a display case embodying the teachings of the present invention.

Turning initially to FIG. 1, there is illustrated a display case, generally referenced 10, that contains a number of trays 12 that embody the present invention. The case contains a center console 13 and a pair of opposed end cabinets 14 and 15 that are attached to the center console by any suitable means. The center console and each of the end cabinets contain horizontally disposed shelves 18 upon which the trays are supported in a side by side alignment.

Figure 4:
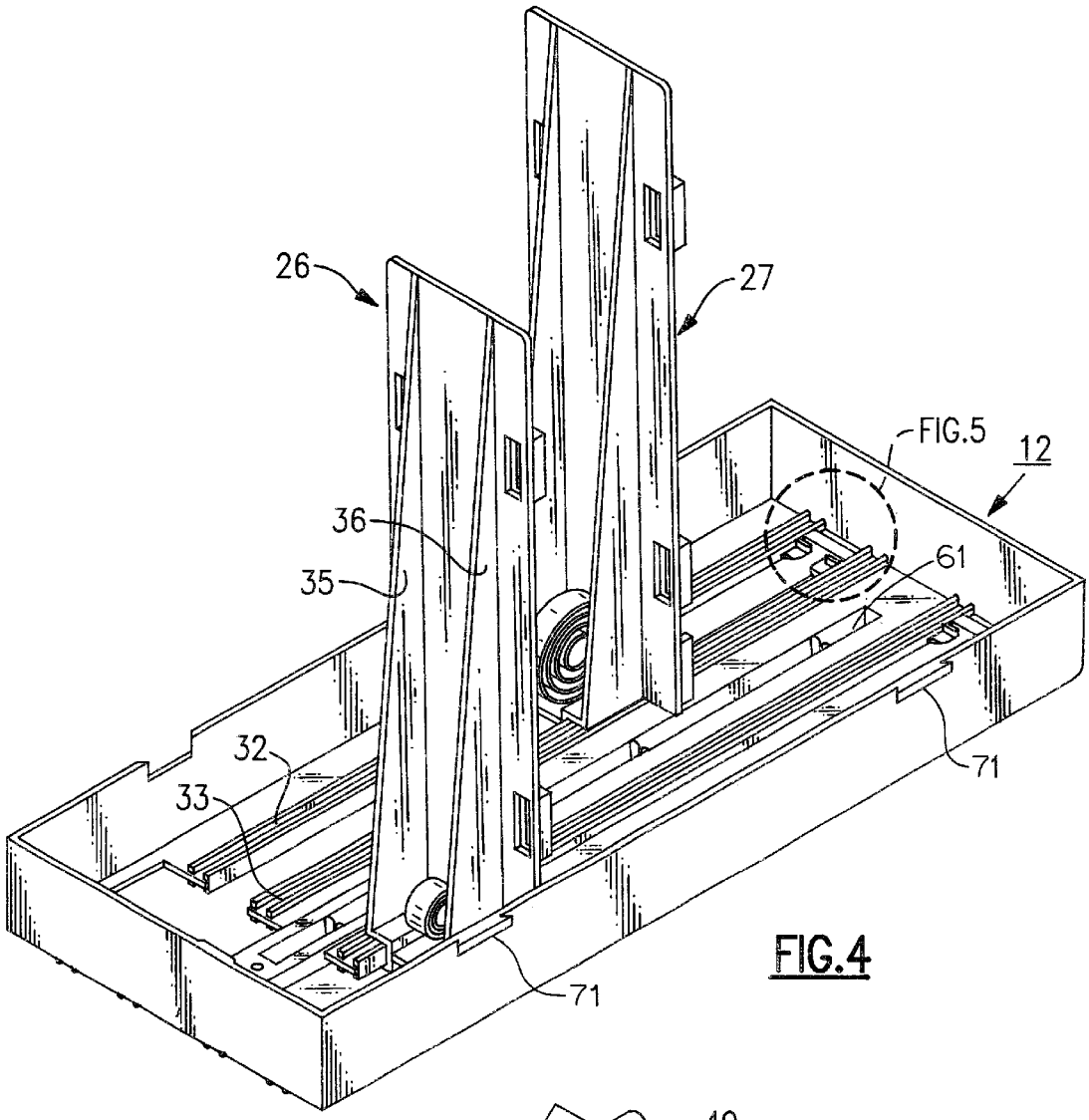
FIG. 4 is a rear perspective view of the tray illustrated in FIG. 2 further illustrating the springs for automatically repositioning the panel within the tray.
Figure 5:
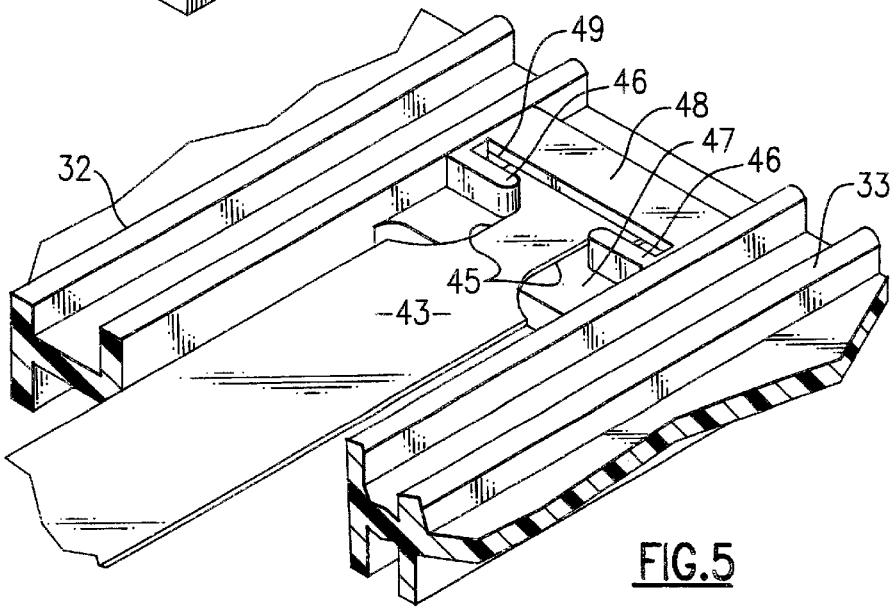
FIG. 5 is a partial enlarged perspective view showing the distal end of one of the springs secured in the front of the tray.
Figure 6:
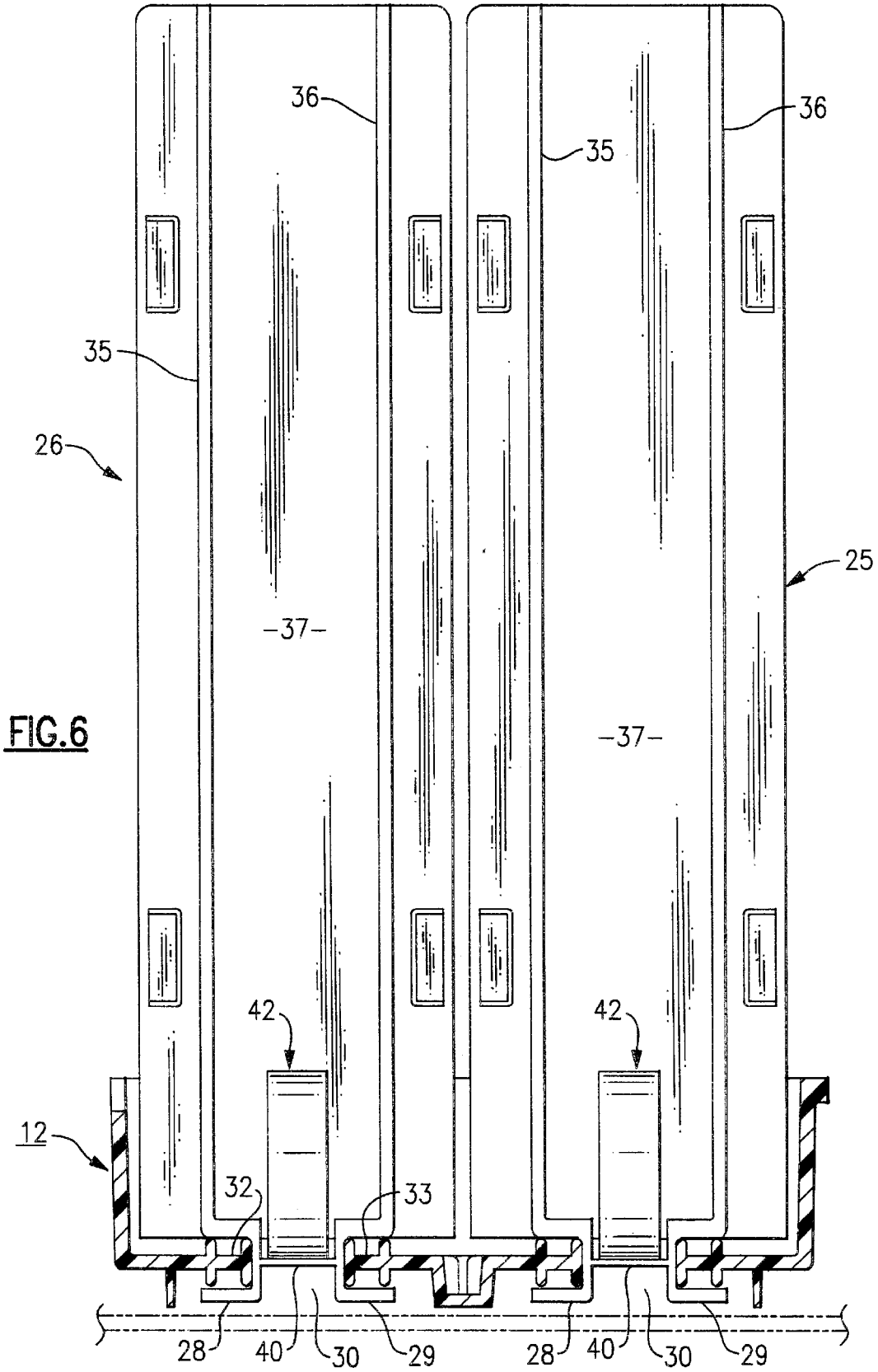
FIG. 6 is an enlarged section view taken along lines 6—6 in FIG. 2.

As illustrated in FIGS. 2–6, each tray 12 is molded of a suitable plastic material and contains a bottom wall 20, a pair of opposed side walls 21 and 22, a front wall 23 and a rear wall 24. A pair of elongated panels 25 and 26 are slidably mounted in the bottom wall of the tray so that the panels can move along independent paths of travel between the rear wall and the front wall of the tray. As best illustrated in FIG. 6, each panel contains a pair of spaced apart channels 28 and 29 that depend downwardly from the bottom edge of the panel. The channels, in assembly, pass through an elongated opening 30 in the bottom wall of the tray and slidably engage a pair of parallel horizontally disposed rails 32 and 33 that extend along the length of the opening 30. The rails are placed parallel to the side walls of the tray and the length of each rail is such that each panel can be guided along the rails as the panel moves along a linear path of travel between the rear wall and the front wall of the tray.

Each panel is supported upon the rails in an upright position and pass upwardly through the open top of the tray. A pair of reinforcing members 35 and 36 are mounted on the rear or back side 37 of each panel. The reinforcing members that extend upwardly form the lower edge of each panel to the upper edge of each panel. The members converge uniformly from the bottom edge towards the top edge of the panel as best illustrated in FIG. 4.

A recessed platform 40 is located between the channel members of each panel and a wound ribbon spring 42 is seated upon the platform behind each panel. The free end 43 (FIG. 5) of the wound ribbon is passed under the panel and along the opening 30 between the rails toward the front wall of the tray. As shown in FIG. 5, the end of the ribbon contains a pair of cutouts 45—45 in which a pair of stops 46—46 are received. The stops are integrally joined to the opposed rails on either side of the opening 30 along with a seat 47 and a cover plate 48. A slit 49 is provided between the cover plate and the stops that permits the distal end of the ribbon to be passed under the cover plate a sufficient distance so that the stops are received within the cutouts as shown. At this time, the end of the ribbon is held in a flat condition against the seat 47 and the trailing portion of the ribbon is held in tension within the opening 30 between the rails.

As should now be evident, the springs function to urge the panels from the rear wall of the tray towards the front wall as the ribbon winds up behind the panel. Accordingly, flat articles, such as boxes stacked between the panels and the front wall of the tray will be held in stacked alignment under the action of the spring. In the event one or more boxes are removed from the stack, the spring driven panel will automatically move forward, thus closing the opening in the depleted stack.

In this particular embodiment of the invention shown in FIG. 4, the tray is configured to accommodate two stacks of flat articles each having a width less than one half the inside width of the tray. As noted above, the tray is ideally suited for displaying and dispensing boxes of flatware with each box containing a complete place setting. It is not unusual within the industry to package two complete place settings within a single box which has a width that is about twice that of the boxes containing a single place setting. To accommodate the larger size boxes with the present tray, the two panels are locked together in a coplanar side by side relationship so that they act in concert to hold the larger size boxes within the tray while still facilitating displaying and easy dispensing of the boxes.

Figure 2:
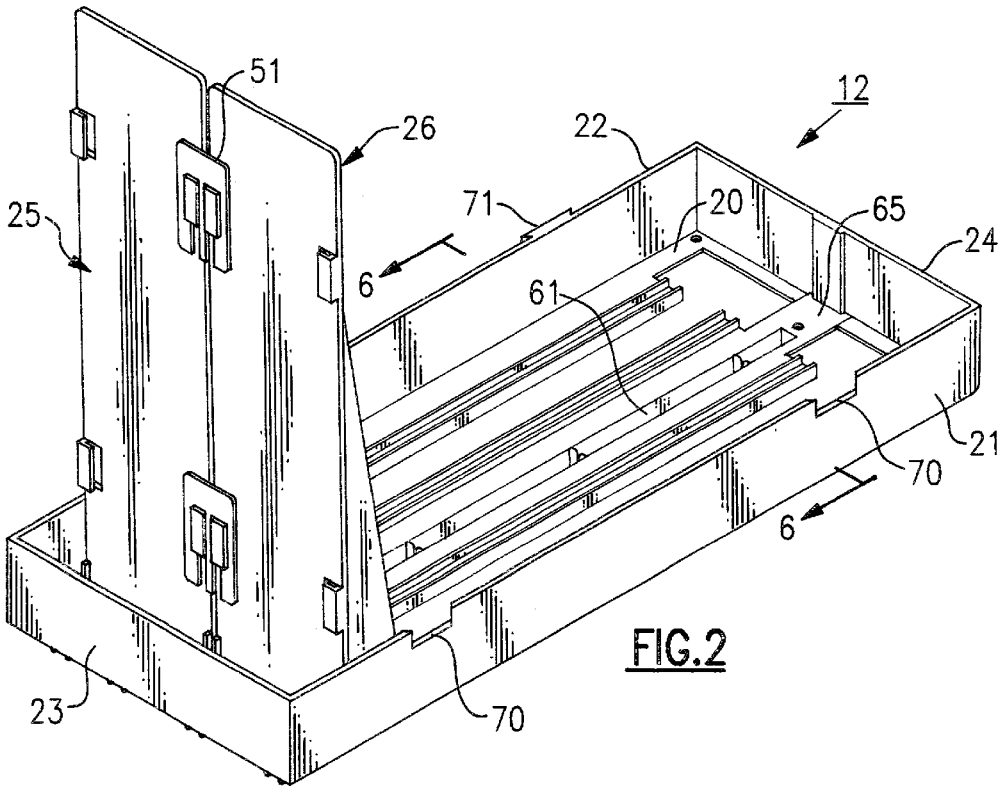
FIG. 2 is a front perspective view of a tray that is employed in the cabinet illustrated in FIG. 1 for displaying and dispensing flat articles showing two movable panels mounted in the tray connected together so that the panels move together within the tray.
Figure 3:
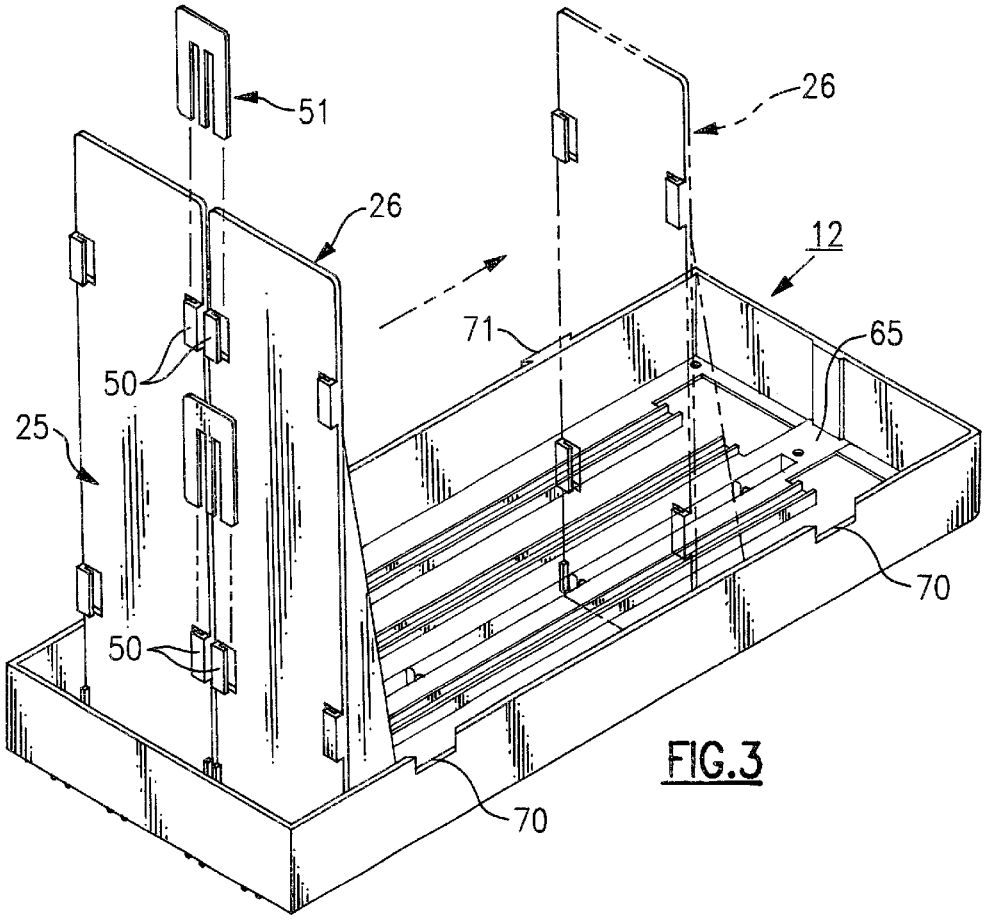
FIG. 3 is a perspective view similar to FIG. 2 wherein the panels are disconnected so that each can move independently within the tray.

Each panel contains a pair of spaced apart L-shaped lugs 50 (FIG. 3) along the inside edge of the panel. The lugs on the panels are at the same elevation along the adjacent edges so that an E-shaped connector 51 can be passed downwardly over the adjacent lugs when the panels are placed in a side by side relationship as illustrated in FIGS. 2 and 3. The connectors each contain a narrow bar 54 connected in its opening between the outer legs which is arranged to pass between the adjacent lugs and hold the panels in alignment when they are locked together as illustrated in FIG. 2.

Figure 8:
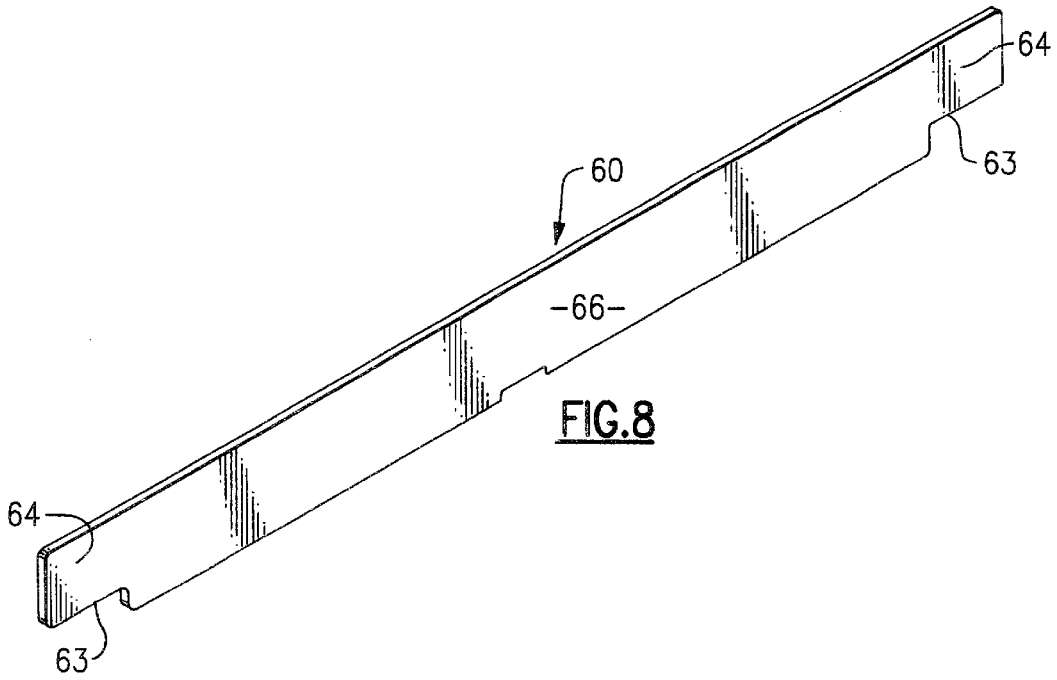
FIG. 8 is a perspective view showing the construction of the removable wall.
Figure 7:
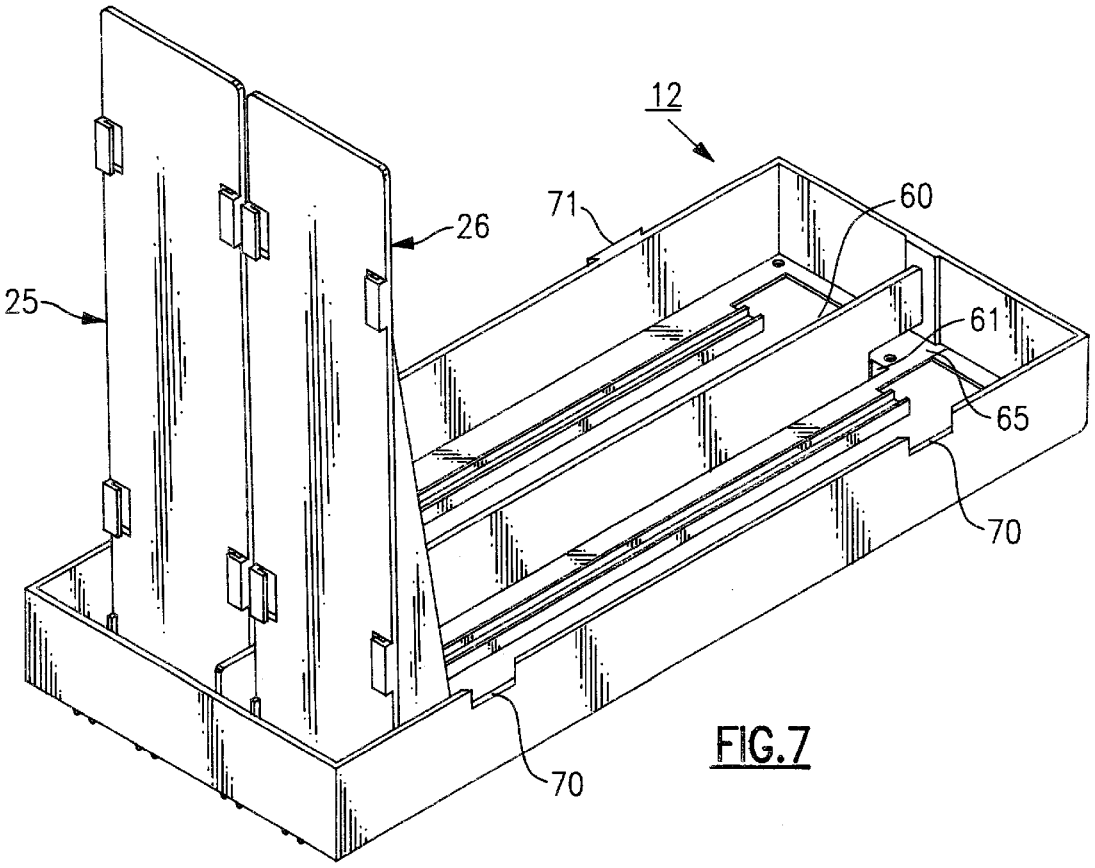
FIG. 7 is a front perspective view of the tray further illustrating a removable wall mounted in the tray between the panel.

Turning now to FIGS. 7 and 8, the tray is equipped with a removable center wall 60 that can be slidably received in an elongated slot 61 that runs down the center of the bottom wall of the tray between the two panels. The removable wall is provided with a pair of opposed cutouts 63—63 at the ends of the wall. The undercut end sections 64 of the wall are arranged to rest upon ledges 65 at either end of the elongated slot when the body section 61 of the wall is inserted into the slot. The center wall, when in place, divides the inside of the tray into two equal size compartments and is utilized when the panels are unlocked and two stacks of small sized packages are being displayed within the tray. The wall is removed when the panels are locked together as explained above and a single stack of larger size boxes is being displayed.

Figure 9:
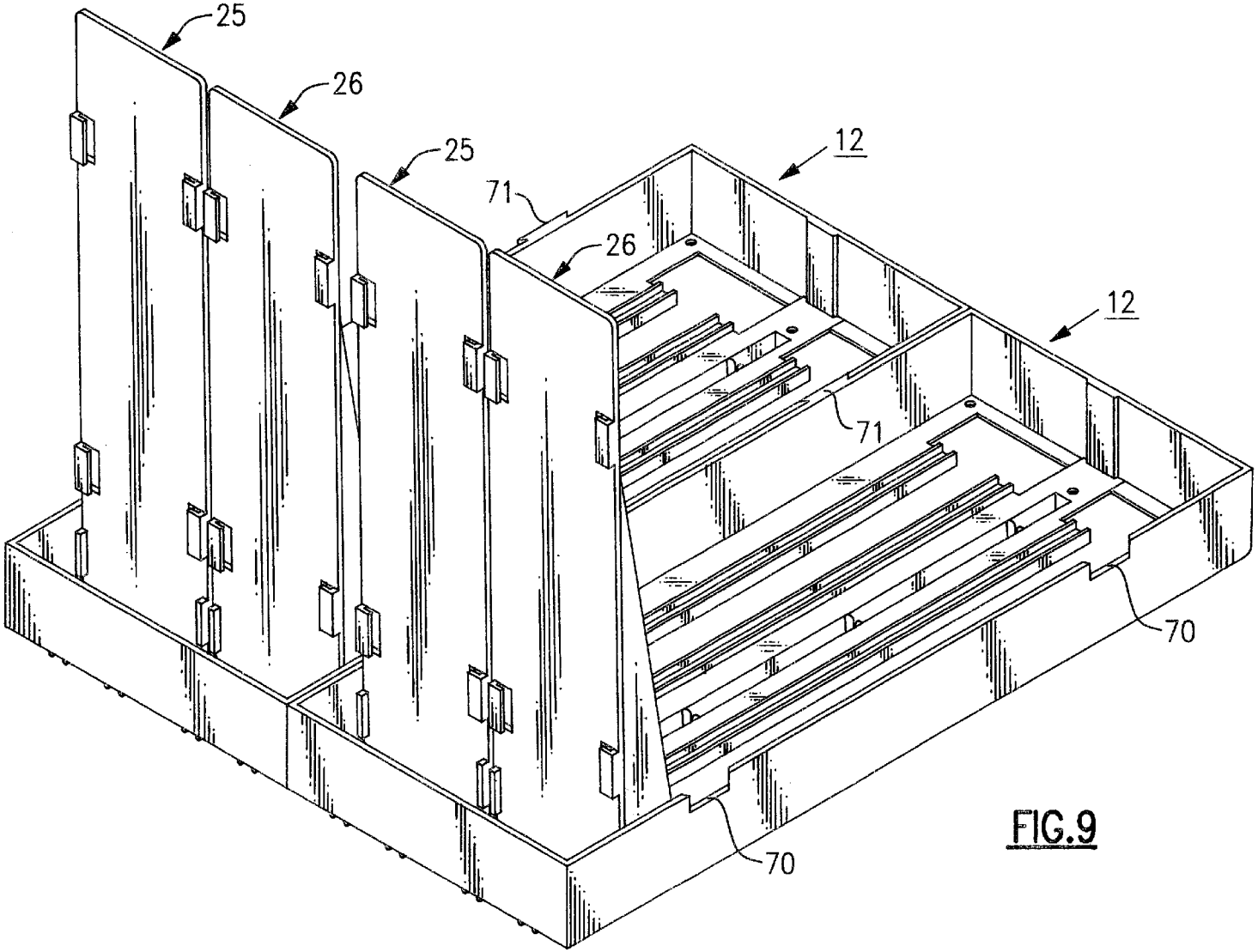
FIG. 9 is a front perspective view illustrating two trays embodying the teachings of the present invention latched together in assembly.

Each tray in the console contains a pair of spaced apart notches 70—70 that are cut into the top edge of the side wall 21 of the tray. Preferably, each notch is cut in the shape of a female dovetail. A pair of outwardly extended ribs 73—73 are integrally joined to the opposing side wall 22 of the tray along the top edge thereof. The lugs are configured in the form of male dovetails that complement the shape of the female dovetails in the opposing side wall of the tray. The ribs are aligned with the notches so that adjacent trays on the shelves of the console can be latched together as shown in FIG. 9 by mating the ribs of one tray with the notches of an adjacent tray. In this way, the trays aligned together upon a common shelf will form a stable unit that will maintain its alignment as boxes are dispensed from the trays. Although a dovetail latching arrangement is shown in this embodiment of the invention, it should be clear that any suitable configuration of mating parts may be utilized without departing form the teachings of the present invention.

While this invention has been explained with reference to the structure disclosed herein, it is not confined to the details set forth and this invention is intended to cover any modifications and changes as may come within the scope of the following claims:

1. Apparatus for displaying and dispensing flat articles that includes an open top tray that includes a bottom wall, a pair of opposed side walls, a front wall and a rear wall, a pair of elongated panels slidably mounted in the bottom wall of said tray that extend upwardly from the bottom wall through the open top of the tray; spring means associated with each of the panels for urging the associated panels along independent paths of travel from the rear wall of the tray toward the front wall; and removable connector means for joining the panels in coplanar alignment so that the panels move together in a side by side relationship whereby articles of varying width can be mounted between the panels and the front wall of the tray.

2. The apparatus of claim 1 wherein said removable connector means further includes at least one connecting unit having a pair of L-shaped lugs mounted upon adjacent side edges of said panels and a removable C-shaped key for slidably engaging both lugs to couple the two panels in coplanar alignment within said tray.

3. The apparatus of claim 2 that includes two connecting units.

4. The apparatus of claim 1 that further includes a pair of parallel guide rails mounted in said bottom wall of said tray beneath each panel, said guide rails extending between said rear wall and said front wall of said tray and each panel further includes means for slidably engaging the guide rails located beneath said panel.

5. The apparatus of claim 1 wherein each panel further includes a pair of reinforcing members that extend upwardly along the back surface of each panel.

6. The apparatus of claim 5 wherein each reinforcing member is generally perpendicular to said panel and converges uniformly from the bottom of the panel towards the top of said panel.

7. The apparatus of claim 1 wherein each spring means is a flat wound ribbon that is mounted behind each panel and said ribbon passing an unwound segment of said ribbon beneath the panel and further includes means to secure an end of said unwound segment of said spring at the front of said tray.

8. The apparatus of claim 7 that further includes a recessed trough between parallel guideways located beneath each panel and said unwound segment of said spring being housed within said recess.

9. The apparatus of claim 1 that further includes a removable wall slidably contained within an elongated slotted opening that is parallel with the side walls of the tray and which passes between said panels, said wall dividing said tray into two equal sized compartments.

10. The apparatus of claim 1 that further includes latching means for interlocking said tray with adjacent trays whereby a series of trays may be latched in a side by side relationship upon a display shelf.

11. The apparatus of claim 10 wherein said latching means further includes a pair of spaced apart cutouts containing female dovetails formed in the top edge of one side wall of the tray and a pair of spaced apart ribs containing male dovetails extending outwardly form the opposing side wall of said tray whereby the lugs of one tray can mate with the cutouts of an adjacent tray.

* * * * *